US009450331B1

(12) United States Patent
Luo

(10) Patent No.: US 9,450,331 B1
(45) Date of Patent: Sep. 20, 2016

(54) HIGH CURRENT CONNECTOR

(71) Applicant: Amphenol East Asia Electronic Technology (Shen Zhen) Co., Ltd., Shenzhen (CN)

(72) Inventor: Yiqiang Luo, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/824,928

(22) Filed: Aug. 12, 2015

(51) Int. Cl.
*H01R 4/38* (2006.01)
*H01R 13/533* (2006.01)

(52) U.S. Cl.
CPC ..... *H01R 13/533* (2013.01)

(58) Field of Classification Search
CPC ..... H01R 13/533; H01R 13/6315; H01R 13/113; H01R 9/091
USPC ..... 439/382
See application file for complete search history.

(56) References Cited

U.S. PATENT DOCUMENTS 6,511,336 B1 * 1/2003 Turek ..... H01R 9/091 439/246
7,731,550 B2 * 6/2010 Falchetti ..... H01R 13/113 439/843
8,672,696 B2 * 3/2014 Sakurai ..... H01R 13/6315 439/247
8,986,030 B2 * 3/2015 Billman ..... H02G 5/02 439/249
9,004,928 B2 * 4/2015 Tanaka ..... B60L 3/0069 439/86

* cited by examiner

*Primary Examiner* — Jean F Duverne
(74) *Attorney, Agent, or Firm* — Howard IP Law Office, Pa; Jeremy Howard

(57) ABSTRACT

The present invention relates to a new high current connector which specifically comprises a terminal assembly and a holder assembly. The terminal assembly includes a resilient conductive terminal component, a terminal base and an inner fastening member. The holder assembly comprises a holding resilient plate component, a holding base, a guide groove member, more than one outer strengthening ribs and an outer fastening member which is provided with more than one vibration-damping holes. The holder assembly is able to warp the terminal assembly from its outside. The resilient conductive terminal component is located at the front portion of the terminal assembly by means of being fastened to the front end of the terminal base. The vibration-damping holes are provided at the connection of the holding base and the outer fastening member. The strengthen ribs extend from the holding resilient plate component to the holding base.

7 Claims, 3 Drawing Sheets

HIGH CURRENT CONNECTOR

TECHNICAL FIELD

The present application relates to the field of high current connector, particularly to a new high current connector.

BACKGROUND OF THE INVENTION

Under high current circumstances, security is the primary standard for the quality of connector products. As one of the important aspects of connector security, anti-deflection plays a significant role in connector security and reliability.

Nowadays, one of the deficiencies of high current connectors is low adaptability upon plugging. That is, the tolerance of the connectors to deflected plugging should be enhanced so as to avoid various potential dangers caused by bad contact and improve the plugging convenience and connecting robustness, thereby further improving the connector security.

SUMMARY OF THE INVENTION

The present invention aims at providing a new high current connector, which possesses a higher tolerance to deflected plugging and at the same time improves the plugging convenience and connecting robustness, thereby enhancing the security and practicability of the whole high current connector.

To solve the above problem, the new high current connector according to the invention comprises a terminal assembly and a holder assembly. The terminal assembly includes a resilient conductive terminal component, a terminal base and an inner fastening member. The holder assembly includes a holding resilient plate component, a holding base, a guide groove, more than one outer strengthening ribs and an outer fastening member which is provided with more than one vibration-damping holes. The holder assembly is able to wrap the terminal assembly from its outside. The resilient conductive terminal component is located at the front portion of the terminal assembly by means of being fastened to the front end of the terminal base. The inner fastening member is connected to the read end of the terminal base and includes two inner fastening plates. By fastening to the holding base, the holding resilient plate component and the guide groove are provided at the front portion of the holder assembly. The outer fastening member is connected to the rear end of the holding base and includes two outer fastening plates. The vibration-damping holes are located at the connection of the holding base and the outer fastening member. The outer strengthen ribs extend from the holding resilient plate component to the holding base.

On the basis of the above mentioned embodiment, the holder assembly is made of stainless steel.

On the basis of the above noted embodiments, the resilient conductive terminal component includes more than one long resilient terminals and more than one short resilient terminals, the holding resilient plate component includes more than one long holding resilient plates and more than one short holding resilient plates. When the terminal assembly is fitted to the holder assembly, each of the long holding resilient plates and the short holding resilient plates respectively clamps one of the long resilient terminals and the short resilient terminals from its outside.

On the basis of the above mentioned embodiment, each of the long resilient terminals and the short resilient terminals is provided with a protrusion at its contacting region.

On the basis of the above disclosed embodiments, the terminal base includes at least one positioning hole, the holding base includes at least one protuberance. When the terminal assembly is fitted to the holder assembly, each protuberance can respectively snap to one positioning hole.

On the basis of the above presented embodiments, the inner fastening member includes at least one inner screw hole, the outer fastening member includes at least one outer screw hole. When the terminal assembly is fitted to the holder assembly, each inner screw hole can be aligned with one outer screw hole.

On the basis of the above mentioned embodiments, when the terminal assembly is fitted to the holder assembly, the outer fastening plates clamp the inner fastening plates, a source conductive plate can be clamped between said two inner fastening plates.

On the basis of the above mentioned embodiments, a flared space is formed between the two inner fastening plates, that is to say, the inner side width of this space is smaller than the outer side width, and the width of the power source conductive plate is smaller than the outer side width but greater than the inner side width.

With the above mentioned technical solutions, the present invention could achieve the following advantageous effects. Firstly, compared with those existing solutions of high current connector, the present technical solutions possess a higher tolerance to plugging deflection. Specifically, the space between the two inner fastening plates is designed to be flared (A1<A2<A3), which enables the receiving conductive plate of different thickness (with size between A1 and A3) to be in good contact with the inner fastening plates, ensuring capacity of high current conduction. Secondly, the present technical solutions realize much better electric conduction. Specifically, each of the resilient terminals is provided with a protrusion at its contacting region, avoiding bad contact between the receiving conductive plate and the resilient terminals due to outward concaving of the terminals at their contacting regions. Thirdly, the plugging is made convenient. Specifically, the resilient conductive terminal component is provided with both long resilient terminals and short resilient terminals, the long terminals contact the receiving conductive plate before the short ones, reducing the initial plugging force. Finally, the present technical solutions result in stronger connection. Specifically, the vibration-damping holes can lower the resilience of the screws held within the inner and outer screw holes, thus avoiding the bad contact between the inner fastening member and the power source conductive plate caused by the great resilience of the screws during vibrations.

DETAILED DESCRIPTION OF THE EMBODIMENTS

Figure 1:
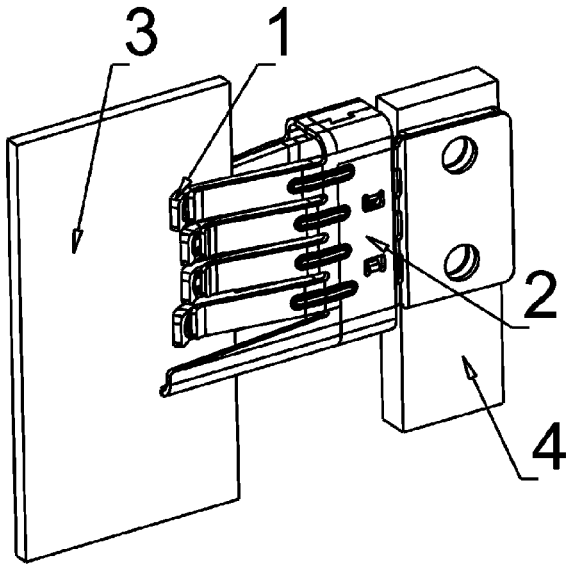
FIG. 1 is an assembly view of a new high current connector.
Figure 2:
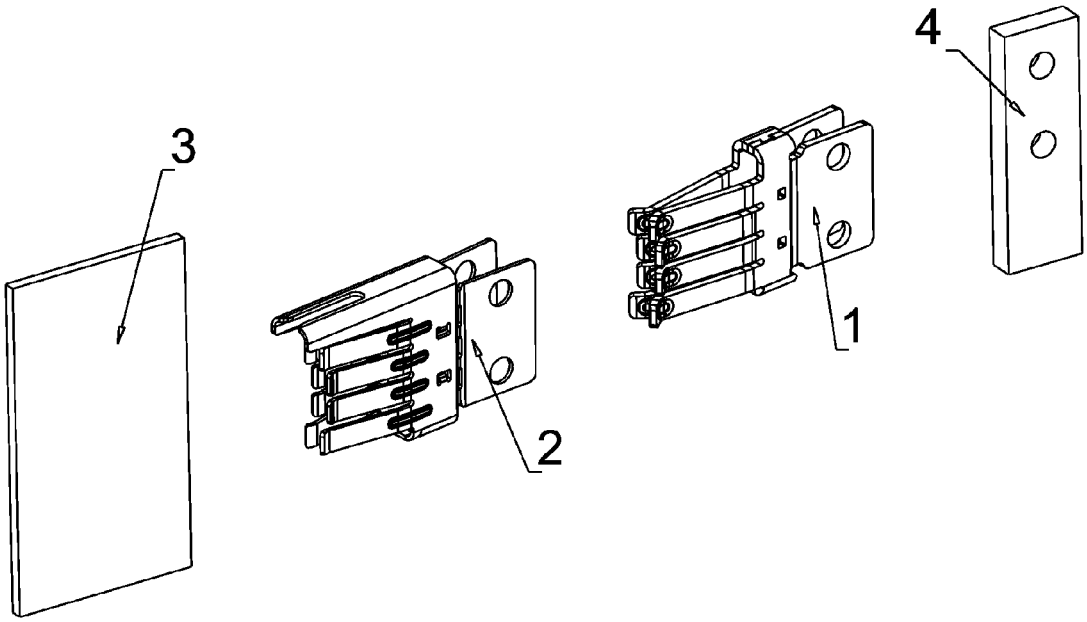
FIG. 2 is an exploded view of the new high current connector.

The present invention will now be described in detail with reference to the specific embodiments, taken in conjunction with FIG. 1 to FIG. 5. However, the description and figures are not intended to limit the scope of the present application.

As shown in FIG. 1 to FIG. 4, a new high current connector comprises a terminal assembly 1 and a holder assembly 2. The terminal assembly 1 includes a resilient conductive terminal component 11, a terminal base 12 and an inner fastening member 13. The holder assembly 2 includes a holding resilient plate component 21, a holding base 22, a guide groove 23, more than one outer strengthening ribs 25 and an outer fastening member 24 which is provided with more than one vibration-damping holes 242. The holder assembly 2 could wrap the terminal assembly 1. The resilient conductive terminal component 11 is located at the front portion of the terminal assembly 1 by means of being fixed to the front end of the terminal base 12. The inner fastening member 13, including two plates, is connected to the rear end of the terminal base 12. By fastening to the holding base 22, the holding resilient plate component 21 and the guide groove 23 are located at the front portion of the holder assembly 2. The outer fastening member 24, including two plates, is located at the rear end of the holding base 22. The vibration-damping holes 242 are located at the connection of the holding base 22 and the outer fastening member 24. The strengthen ribs 25 extend from the holding resilient plate component 21 to the holding base 22.

On the basis of the above mentioned embodiment, the holder assembly 2 is made of stainless steel.

Figure 3:
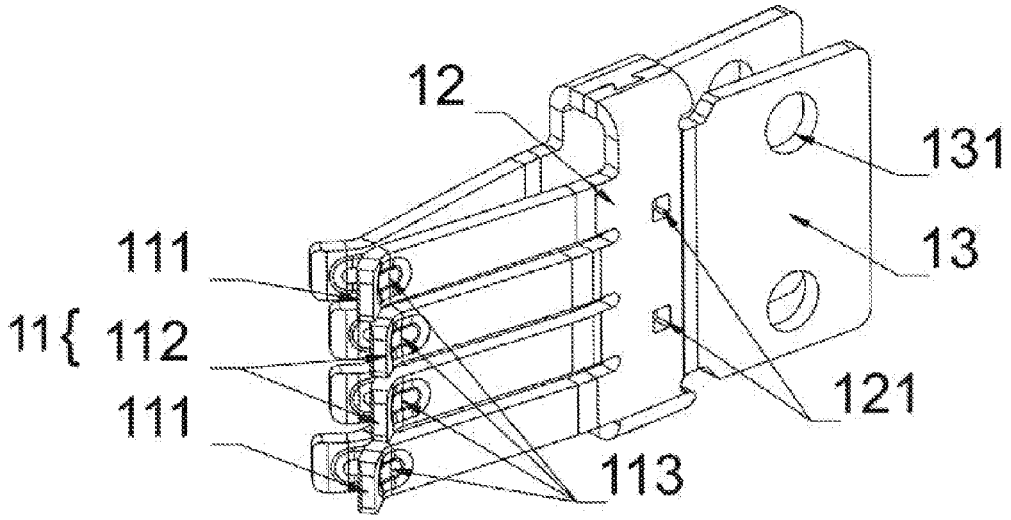
FIG. 3 shows the terminal assembly of the new high current connector.
Figure 4:
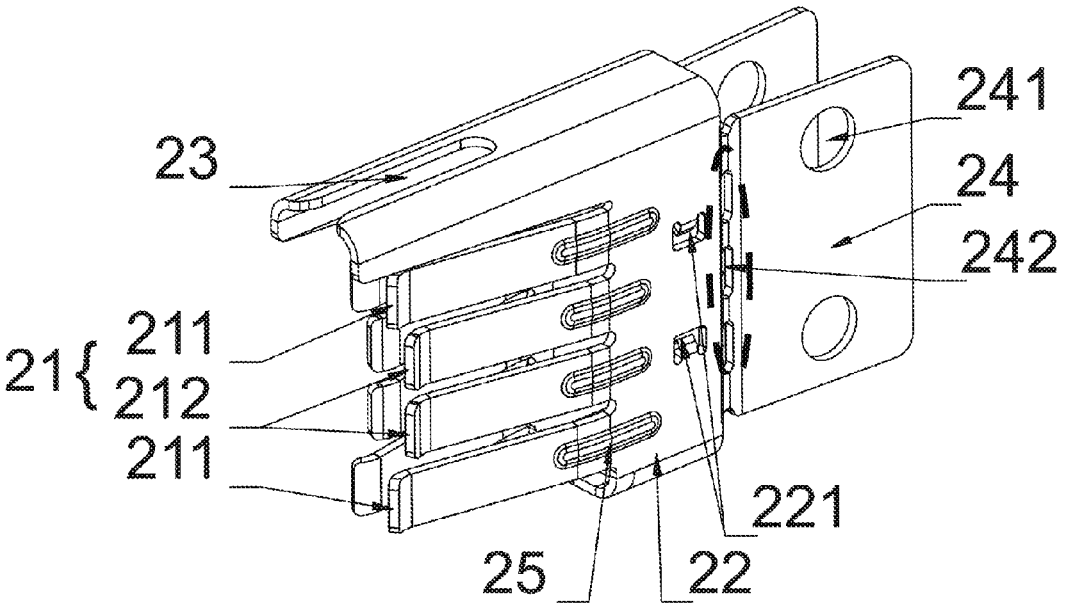
FIG. 4 shows the holder assembly of the new high current connector.

As shown in FIG. 3 and FIG. 4, on the basis of the above noted embodiments, the resilient conductive terminal component 11 includes more than one long resilient terminals 111 and more than one short resilient terminals 112. The holding resilient plate component 21 includes more than one long holding resilient plates 211 and more than one short holding resilient plates 212. When the terminal assembly 1 is fitted to the holder assembly 2, each of the long holding resilient plates 211 and short holding resilient plates 212 respectively clamps one of the long resilient terminals 111 and short resilient terminals 112 from the outside.

As shown in FIG. 3, on the basis of the above described embodiments, each of the long resilient terminals 111 and short resilient terminals 112 is provided with a protrusion 113 at its contacting region.

As shown in FIG. 3 and FIG. 4, on the basis of the above disclosed embodiments, the terminal base 12 includes at least one positioning hole 121. The holding base 22 includes at least one protuberance 221. When the terminal assembly 1 is fitted to the holder assembly 2, each protuberance 221 can respectively snap to one positioning hole 121.

As shown in FIG. 3 and FIG. 4, on the basis of the above presented embodiments, the inner fastening member 13 includes at least one inner screw hole 131. The outer fastening member 24 includes at least one outer screw hole 241. When the terminal assembly 1 is fitted to the holder assembly 2, each inner screw hole 131 can be aligned with one outer screw hole 241.

Figure 5:
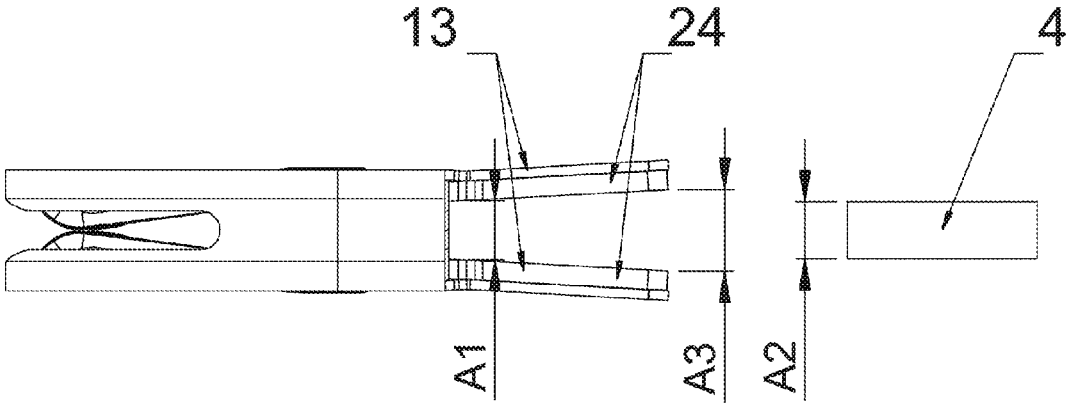
FIG. 5 is a bottom view of the new high current connector.

As shown in FIG. 5, on the basis of the above mentioned embodiments, when the terminal assembly 1 is fitted to the holder assembly 2, the outer fastening plates 24 clamp the inner fastening plates 13 from the outside, a power source conductive plate 4 can be clamped between said two inner fastening plates 13.

As shown in FIG. 5, on the basis of the above mentioned embodiments, a flared space is formed between the two inner fastening plates 13, that is to say, the inner side width A1 of this space is smaller than the outer one A3, and the width A2 of the power source conductive plate 4 is smaller than A3 but greater than A1.

On the basis of the above presented embodiments, there are an installation step and a connection step for the present high current connector. The installation step includes: wrap the outer surface of the terminal assembly 1 with the holder assembly 2, particularly, clamp the long holding resilient plates 211 and the short holding resilient plates 212 respectively to the outsides of the long resilient terminals 111 and the short resilient terminals 112, snap each protuberance 221 to one positioning hole 121, clamp the outer fastening member 24 to the outside of the inner fastening member 13 and align the inner screw holes 131 with the outer screw holes 241. The connection step includes: insert a receiving conductive plate 3 into the front portion of the terminal assembly 1, specifically, clamp the receiving conductive plate 3 within the resilient conductive terminal component 11; insert the power source conductive plate 4 into the rear portion of the terminal assembly 1, specifically, clamp the power source conductive plate 4 within the flared space between the two inner fastening plates 13.

From the common knowledge in the art, the present invention can be realized by other embodiments which do not depart from the spirit and essential features of the application. Therefore, under any circumstances, the above disclosed embodiments are intended for the purpose of illustration only, and are not intended to be exhaustive. The modifications and variations within the scope of the application or its equivalents will fall within the protection scope of the invention.

The invention claimed is:

1. A high current connector comprising: a terminal assembly (1) and a holder assembly (2), wherein the terminal assembly (1) includes a resilient conductive terminal component (11), a terminal base (12) and an inner fastening member (13), characterized in that the holder assembly (2) includes a holding resilient plate component (21), a holding base (22), a guide groove (23), more than one outer strengthening ribs (25) and an outer fastening member (24) which is provided with more than one vibration-damping holes (242);

wherein the holder assembly (2) is able to wrap the terminal assembly (1) from the outside;

wherein the resilient conductive terminal component (11) is located at the front portion of the terminal assembly (1) by means of being fixed to the front end of the terminal base (12);

wherein the inner fastening member (13) is connected to the rear end of the terminal base (12) and includes two inner fastening plates;

wherein the holding resilient plate component (21) and the guide groove member (23) are located at the front portion of the holder assembly (2) by means of being fastened to the holding base (22);

wherein the outer fastening member (24) is connected to the rear end of the holding base (22) and includes two outer fastening plates;

wherein the vibration-damping holes (242) are located at the connection of the holding base (22) and the outer fastening member (24);

wherein the outer strengthening ribs (25) extend from the holding resilient plate component (21) to the holding base (22);

wherein the holder assembly (2) is made of stainless steel; and wherein the resilient conductive terminal component (11) includes more than one long resilient terminals (111) and more than one short resilient terminals (112), the holding resilient plate component (21) includes more than one long holding resilient plates (211) and more than one short holding resilient plates (212); when the terminal assembly (1) is fitted to the holder assembly (2), each of the long holding resilient plates (211) and the short holding resilient plates (212) respectively clamps the long resilient terminals (111) and the short resilient terminals (112) from the outsides.

2. The high current connector according to claim 1, characterized in that each of the long resilient terminals (111) and the short resilient terminals (112) is provided with a protrusion (113) at its contacting region.

3. The high current connector according to claim 2, characterized in that the terminal base (12) includes at least one positioning hole (121), the holding base (22) includes at least one protuberance (221); when the terminal assembly (1) is fitted to the holder assembly (2), each protuberance (221) can respectively snap to one positioning hole (121).

4. The high current connector according to claim 3, characterized in that the inner fastening member includes at least one inner screw hole, the outer fastening member (24) includes at least one outer screw hole (241); when the terminal assembly (1) is fitted to the holder assembly (2), each inner screw hole (131) can be aligned with one outer screw hole (241).

5. The high current connector according to claim 4, characterized in that when the terminal assembly (1) is fitted to the holder assembly (2), the outer fastening plates (24) clamp the inner fastening plates (13) from the outside, a power source conductive plate (4) can be clamped between said two inner fastening plates (13).

6. The high current connector according to claim 5, characterized in that a flared space is formed between the two inner fastening plates (13), and the inner side width A1 of the flared space is smaller than the outer side width of the flared space A3, and the width A2 of the power source conductive plate (4) is smaller than the outer side width A3 but greater than the inner side width A1.

7. A high current connector comprising:

a terminal assembly; and a holder assembly, wherein the terminal assembly includes a resilient conductive terminal component, a terminal base and an inner fastening member, characterized in that the holder assembly includes a holding resilient plate component, a holding base, a guide groove, more than one outer strengthening ribs and an outer fastening member which is provided with more than one vibration-damping holes;

wherein the holder assembly is able to wrap the terminal assembly from the outside;

wherein the resilient conductive terminal component is located at the front portion of the terminal assembly by means of being fixed to the front end of the terminal base;

wherein the inner fastening member is connected to the rear end of the terminal base and includes two inner fastening plates;

wherein the holding resilient plate component and the guide groove member are located at the front portion of the holder assembly by means of being fastened to the holding base;

wherein the outer fastening member is connected to the rear end of the holding base and includes two outer fastening plates;

wherein the vibration-damping holes are located at the connection of the holding base and the outer fastening member;

wherein the outer strengthening ribs extend from the holding resilient plate component to the holding base;

wherein the resilient conductive terminal includes more than one long resilient terminals and more than one short resilient terminals, the holding resilient plate component includes more than one long holding resilient plates and more than one short holding resilient plates; and wherein, when the terminal assembly is fitted to the holder assembly, each of the long holding resilient plates and the short holding resilient plates respectively clamps the long resilient terminals and the short resilient terminals from the outsides.

* * * * *